United States Patent [19]

Biewer

[11] 4,062,192

[45] Dec. 13, 1977

[54] METHOD OF AND MECHANISM FOR GENERATING WAVES SUITABLE FOR SURFING

[75] Inventor: Frank N. Biewer, San Diego, Calif.

[73] Assignee: Offshore Technology Corporation, Escondido, Calif.

[21] Appl. No.: 550,531

[22] Filed: Feb. 18, 1975

Related U.S. Application Data

[63] Continuation of Ser. No. 475,402, June 3, 1974, abandoned, which is a continuation of Ser. No. 333,726, Feb. 20, 1973, abandoned, which is a continuation-in-part of Ser. No. 136,064, April 21, 1971, abandoned.

[51] Int. Cl.[2] ..... E02B 3/00; E04H 3/18

[52] U.S. Cl. ..... 61/1 R; 4/172.16

[58] Field of Search ..... 61/1 R; 4/171, 172.16, 4/178, 16; 272/26, 32, 17

[56] References Cited

U.S. PATENT DOCUMENTS

| | | | |
|---|---|---|---|
| 490,484 | 1/1893 | Mackaye | 272/26 |
| 586,983 | 7/1897 | Wharton | 4/172.16 |
| 2,002,043 | 5/1935 | Price | 4/171 |
| 3,350,724 | 11/1967 | Leigh | 4/171 |
| 3,562,823 | 2/1971 | Koster | 4/172.16 |

*Primary Examiner*—Jacob Shapiro

*Attorney, Agent, or Firm*—Brown & Martin

[57] ABSTRACT

Mechanism which provides a method and apparatus for constantly and cyclically generating, within a body of water remote from a shoal, series of waves of different lengths, which waves merge and cooperate with a shoal to form a single wave in an area that lies substantially above the shoal. The power generated by the merging of the waves is sufficient to form that single wave into one that functions as a surfing wave.

The invention further provides for the forming of a shoal and beach if natural shoal and beach are not present. An artificial shoal is constructed and in cooperation with the generated waves, those waves will travel up the slope of the shoal to form waves suitable for surfing.

12 Claims, 13 Drawing Figures

METHOD OF AND MECHANISM FOR GENERATING WAVES SUITABLE FOR SURFING

CROSS-REFERENCE TO RELATED APPLICATION

This application is a continuation of applicant's co-pending application, Ser. No. 475,402 filed June 3, 1974 now abandoned, which was a continuation of applicant's co-pending application Ser. No. 333,726 filed Feb. 20, 1973, now abandoned, that was a continuation-in-part of applicant's co-pending application Ser. No. 136,064 filed Apr. 21, 1971, now abandoned.

BACKGROUND OF THE INVENTION

1. Field of the Invention

The invention relates to generating waves that simulate natural surfing waves.

2. Description of the Prior Art

The prior art patents cited in a recent search are as follows:

| U.S. PAT. NO. | ISSUED | TO |
|---|---|---|
| 3,477,233 | November 11, 1969 | P. F. Andersen |
| 3,473,334 | October 21, 1969 | P. Dexter |
| 2,056,855 | October 6, 1936 | F. K. Herz |
| 400,484 | January 24, 1893 | S. Mackaye |
| 3,005,207 | October 24, 1961 | M. Matrai |
| 1,181,406 | May 2, 1916 | T. I. Potter |
| 2,002,043 | May 21, 1935 | O. A. Price |
| 588,983 | July 27, 1897 | W. Wharton, Jr. |
| 2,222,010 | November 19, 1940 | L. J. Witte, et al. |

Dexter alone discloses mechanism for creating a wave that may be suitable for surfing. However, Dexter's apparatus requires the expenditure of a large amount of energy to fill a tank with sufficient water which, when released, effects a single surge of water towards a shoal.

SUMMARY OF THE INVENTION

Applicant provides mechanism for creating, cyclically, many relatively small waves, each cycle including a series of waves of different lengths, preferably increasing sequentially in lengths. All of these series of different length waves overtake and reinforce one another at an area above the shoal to form a single wave of the type that is suitable for surfing.

In one embodiment of the invention, a plurality of wave-generating members may be employed, and these members are actuated in out-of-phase relationship with one another. In another embodiment, a plurality of wave-generating members are disposed in an arc. In still another embodiment, wave-generating members are arranged parallelly, but one or more are arranged forwardly of others.

Before delving into the description of the invention, the explanation of certain characteristics of water waves which play an interesting part in the present invention is deemed in order. It is of interest to observe that:

a. In deep water the velocity of an oscillatory wave is proportional to the wave periods, i.e., a longer period wave travels faster than a shorter period wave;

b. Waves entering shallow water from deep water are impeded by the bottom of the ocean, reservoir, lake, etc., and tend to slow, crest and become unstable;

c. Long period waves extend deeper into the water than shorter period waves;

d. In an oscillatory wave, the water particles move in basically orbital paths, with the diameter of the orbits decreasing exponentially with depth;

e. Waves that are generated by an extended plane surface, unless influenced by extraneous factors, tend to travel in a direction perpendicular to the plane surface.

In the open sea, waves of many periods and heights exist. The waves come from a variety of disturbances and it is common to speak of this as a random sea. When waves enter the shallow water associated with a coastline, they are refracted or bent and approach the beach in a direction perpendicular to the beach. Under the influence of shallow water, the waves change their character from oscillatory to translatory, and a significant amount of water may actually roll up on the beach. The height and period of the wave, the depth of water, the slope of the bottom and the character of the bottom determine the form of the wave that comes in to the beach.

People who engage in the sport of surfing usually prefer a spilling type of breaker, rather than a plunging or surging breaker, and one in which the break progresses across the face of the wave. (In the jargon of surfing, this is known as a pocket which moves across the face of the wave.)

Random waves in relatively deep water will be observed to move at different speeds with the longer waves overtaking and reinforcing the shorter waves, then separating again into the component waves. If, however, this reinforcement takes place where the bottom becomes shallow, the wave can be rendered unstable and it will start to break and continue breaking as it continues on to the beach.

Other features and the advantages of the present invention will be apparent from the following description, reference being had to the accompanying drawings wherein preferred embodiments of the invention are illustrated.

DESCRIPTION OF THE PREFERRED EMBODIMENTS

Figure 1:
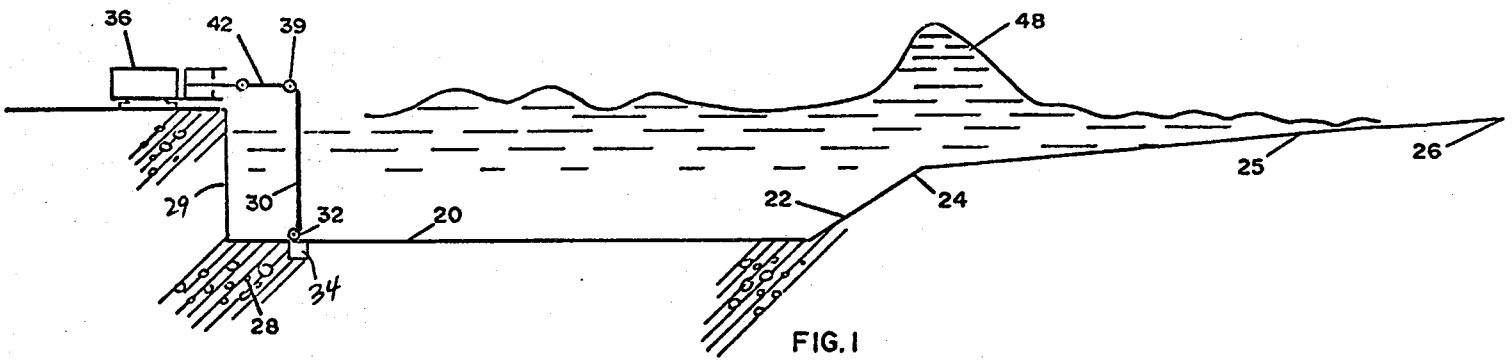
FIG. 1 is a schematic sectional view showing one form of the invention employed in a body of water having a shoal.

Referring first to FIG. 1, the ocean or bay floor or man-made floor is shown at 20. The floor inclines as at 22 to form a shoal 24. The floor declines to the right of the shoal toward the beach 25 and the shore 26.

In practicing the invention for use in an ocean or in a bay, wherein the natural waves do not cooperate with a shoal to form waves suitable for surfing, it is necessary usually to form a foundation such as that shown at 28. In one embodiment a wave-generating member 30 in the form of a flap is pivotally attached by pivot 32 to a stationary anchor 34 that is fixed on the floor 20. This flap 30 is arranged parallelly with the general shape of the shoal. As shown, the flap 30 is interposed between the foundation 28 and the shoal 24. As shown more clearly in FIG. 3, the cylinder 36 of a hydraulic motor 38 is pivotally mounted on a base 40 on the foundation. The ram 42 of the motor 38 is connected by pivot 39 to the top portion of the flap 30. The flap is reciprocated by reciprocation of the ram 42.

The reciprocation of the flap 30 causes waves to be generated and move toward the shoal. In practicing the present invention, numerous waves of different lengths are generated cyclically. Preferably from four to 10 different length waves are generated during each cycle and the lengths of the waves are increased in length sequentially during each cycle. All of the waves of each cycle overtake one another above the shoal to form a wave of sufficient height and power to have the value of a surfing wave that moves from the shoal 24 toward the shore.

As an example herein chosen, each cycle extends over a period of 22½ seconds and upon reoccurring, they simulate reoccurring natural surfaces in an ocean. While not limited thereto, the flap 30 is deeply immersed in water and extends a distance of between 5 to 25 feet from the base of the foundation.

As a point of explanation, different periods of waves provide waves having different wave lengths. The period of a particular wave is set by the time required in generating the wave. This is established by the wave length being equal to the square of the wave period, times a constant. For example, a wave period of 4 seconds can be expected to provide a wave length of about 80 feet, which can vary depending upon other constant and determinable known factors that comprise the constant. The term wave length means the length of the wave in the direction of its movement and does not mean the width of the wave in a direction perpendicular to the direction of movement of the wave. The longer period or longer wave length waves travel faster at substantially constant speed than the shorter period or shorter wave length waves. Thus the faster travelling, longer waves produced last in a cycle of generating a plurality of waves, overtake the shorter wave length waves. So the time spacing in generating a series of waves in a cycle and the period or the wave length of each wave can be set, whereby the waves combine or merge at a given point. In this embodiment, that point is the area above the shoal 24.

While not limited thereto, the example selected to illustrate the invention comprehends the generation of four waves for each cycle, which waves increase sequentially per cycle. The time of merging of the four waves of a cycle at the shoal will be considered at time minus zero ($t$-0). A 4-second wave 44 is started at $t$-75.8 seconds; a 4½ second wave 45 is started at $t$-71.8 seconds; a 5-second wave 46 is started at $t$-67.3 seconds; and an 8-second wave 47 is started at $t$-62.3 seconds. The merged waves, so timed, generate the surfing wave 48 shown in FIG. 9.

Figure 9:
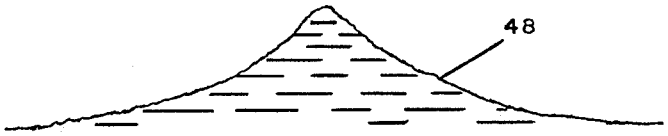
FIG. 9 shows the resultant wave when the four waves merge.

FIGS. 5 through 8 depict, respectively, the lengths of the four waves, and FIG. 9 depicts the approximate height when the four waves are superimposed on one another to form the surfing wave. Several trains of waves, each of increasing lengths, can be en route to the shoal at the same time. In the embodiment illustrated, the series of four waves is completed at $t$-54.3 seconds and then another series of like length waves are started.

Figure 2:
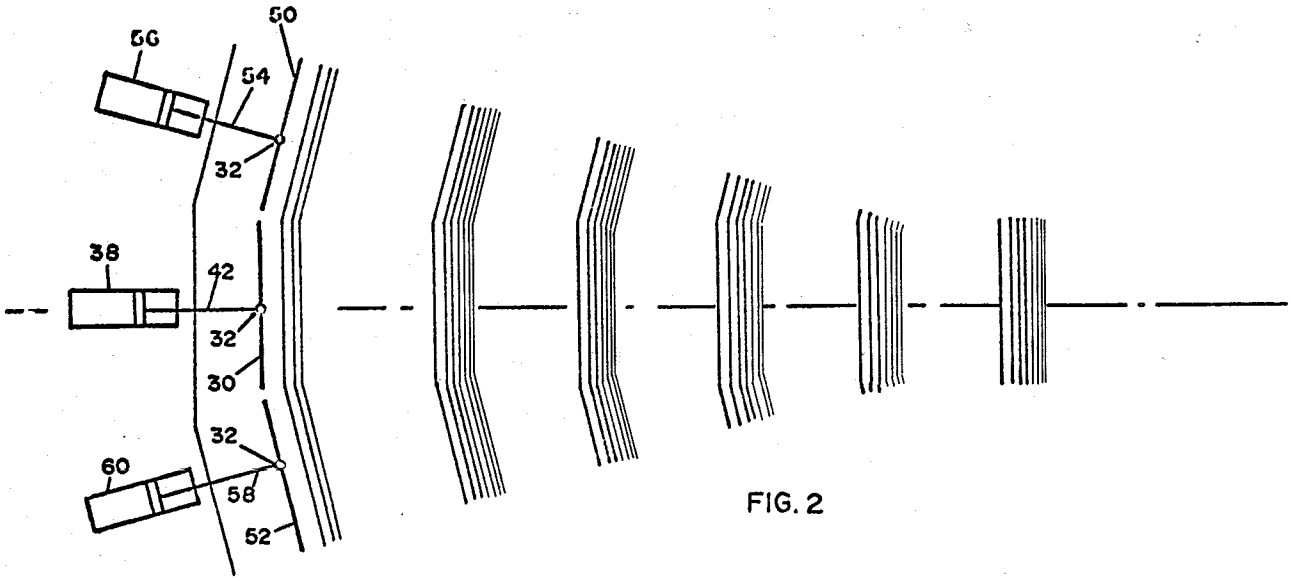
FIG. 2 is a top plan view of FIG. 1, but showing three wave-generating members that are disposed in an arc and showing the hydraulic motors for actuating the same.

Refer now to the embodiment shown in FIG. 2, wherein two flaps 50 and 52 are employed in addition to flap 30. The flaps are arranged in an arc. Flap 50 is disposed adjacent to but spaced from the left side of flap 30 and flap 52 is disposed adjacent to but spaced from the right side of flap 30. Flaps 50 and 52 are disposed at an angle relative to flap 30. Flap 50 is reciprocated by ram 54 of a hydraulic motor 56 and flap 52 is reciprocated by a ram 58 of a hydraulic motor 60. The hydraulic motors 56 and 60 are mounted on the island as explained with respect to the mounting of motor 38.

In this embodiment, the three flaps 30, 50 and 52 are reciprocated in phase with one another, and the waves generated by flaps 30, 50 and 52 merge above the shoal. By placing these wave-generators 30, 50 and 52 in an arc, the prevention of dispersion of the waves is enhanced.

In another embodiment, the waves generated by flap 50 merge along the shoal and adjacent the left side of those generated by flap 30 and in that embodiment, the waves generated by flap 52 merge at the shoal to the right of those waves generated by flap 30. Too, if desirable, either the waves generated by flaps 50 and 30 can merge at the shoal while the waves generated by flap 52 can merge to the right of those generated by the combination of the waves generated by flaps 50 and 30. In all of these embodiments, from a visual standpoint, it appears that the waves move toward the shoal from different directions.

If desirable, the wave flaps 30, 50 and 52 can be operated in slightly out-of-phase relationship with one another to produce a surfing wave that strikes the shoal at an angle. This is desirable for the sport of surfing.

Figure 4:
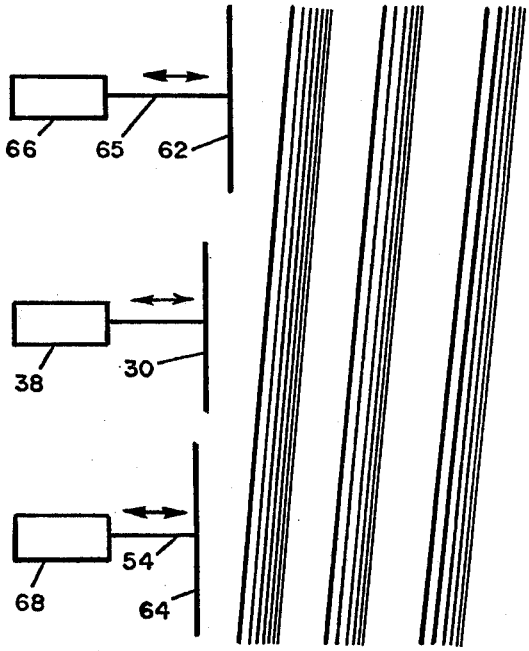
FIG. 4 is a top plan view of an embodiment of the invention in which a plurality of wave-generating members are arranged in parallel but staggered relationship with one another.
Figure 11:
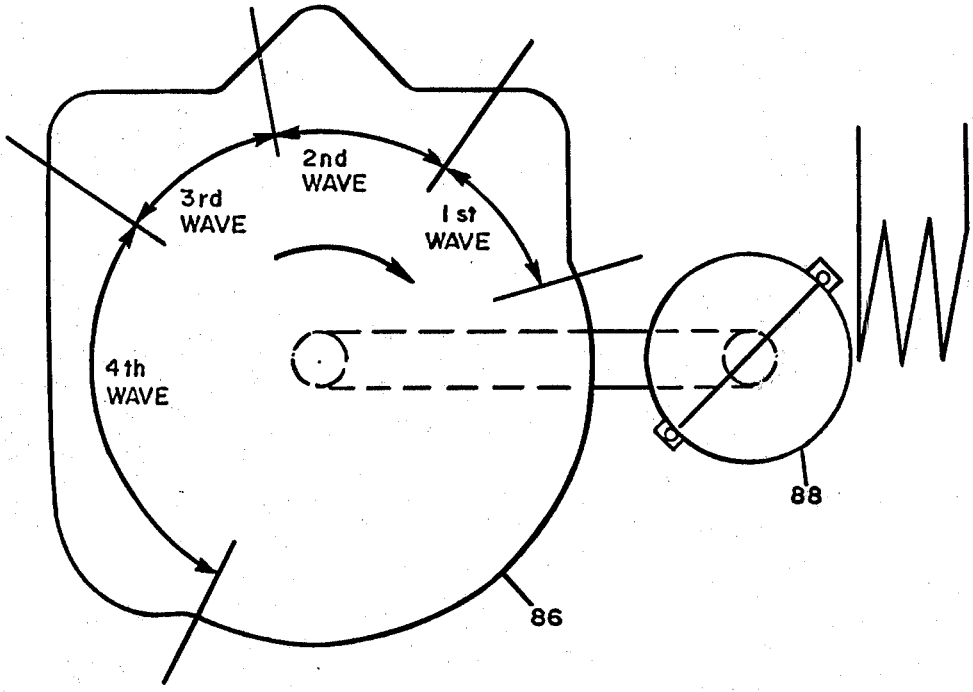
FIG. 11 is a front view of a cam that controls the movements of a wave-generating member in frequency and height, and showing a motor for rotating the cam.
Figure 5:
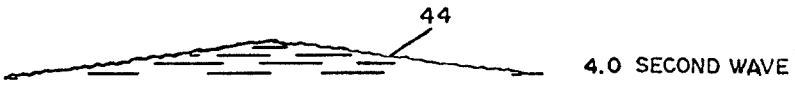
FIGS. 5 through 8 are views of four waves that are generated sequentially during a single cycle of wave generation, the views being parallel with the wave-generating members shown in FIGS. 1 and 3.
Figure 6:
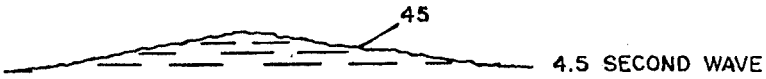
Figure 7:
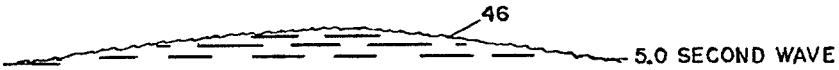
Figure 8:
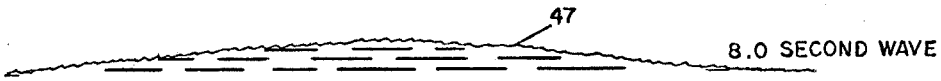

Still another embodiment is shown in FIG. 4, wherein flaps 62 and 64 are arranged parallelly with flap 30. Flap 62 is reciprocated by a ram 65 of hydraulic motor 66, and flap 64 is reciprocated by a hydraulic motor 68. These motors reciprocate their respective flaps in out-of-phase relationship. Such out-of-phase relationship gives the appearance of wave fronts moving toward the shoal from a direction other than perpendicular to the direction of wave travel. The resulting merged wave is desirable also in surfing.

It is to be understood that the angle at which the waves are generated by the flaps can be controlled to effect surfing waves that are generated on curved shoals.

Figure 12:
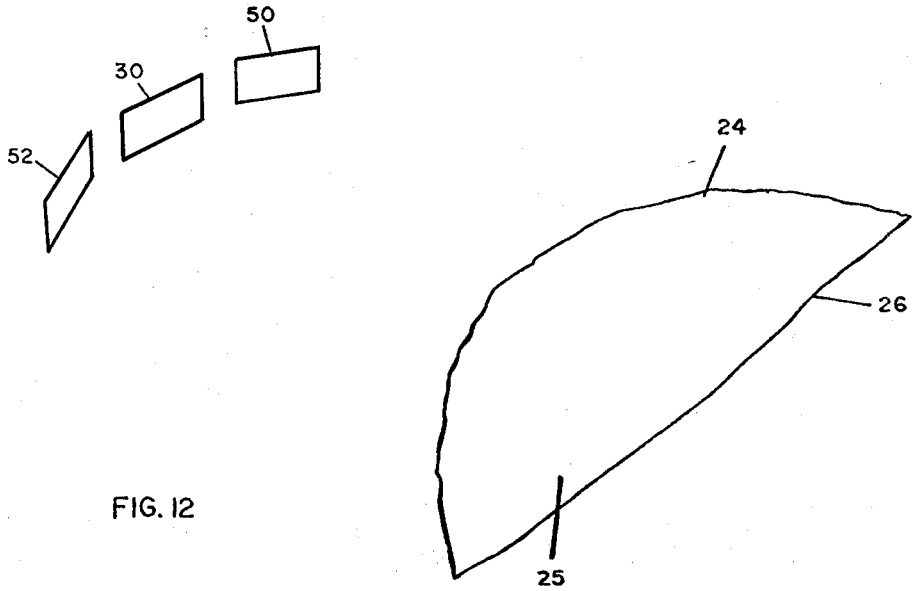
FIG. 12 is a perspective view of a man-made shoal and a schematic view of the wave generators.

When the invention is adapted for a reservoir, bay, river lake, estuary, or also in the ocean where no shoal is present for forming a surfing wave, such shoal can be formed in the reservoir, bay, river or ocean; or if an inadequate shoal is present in a bay, river, or ocean, it can be altered to form a bottom having an incline as at 22 toward the shoal 24 and to maintain a shallow upwardly extending floor from the shoal along the beach 25 so that the wave will not separate into its component parts as it would in deep water. Such upwardly sloping floor and shoal, in cooperation with the present invention, provides a floor and shoal having the contours to form a surfing wave. Referring now to FIG. 12, the shoal 24 is shown as slightly convexed. This shape slows the center of the waves as they move upwardly along the shoal due to the influence of friction of the water with the shoal. Thus the waves are focused and this focusing enhances the wave height.

Figure 10:
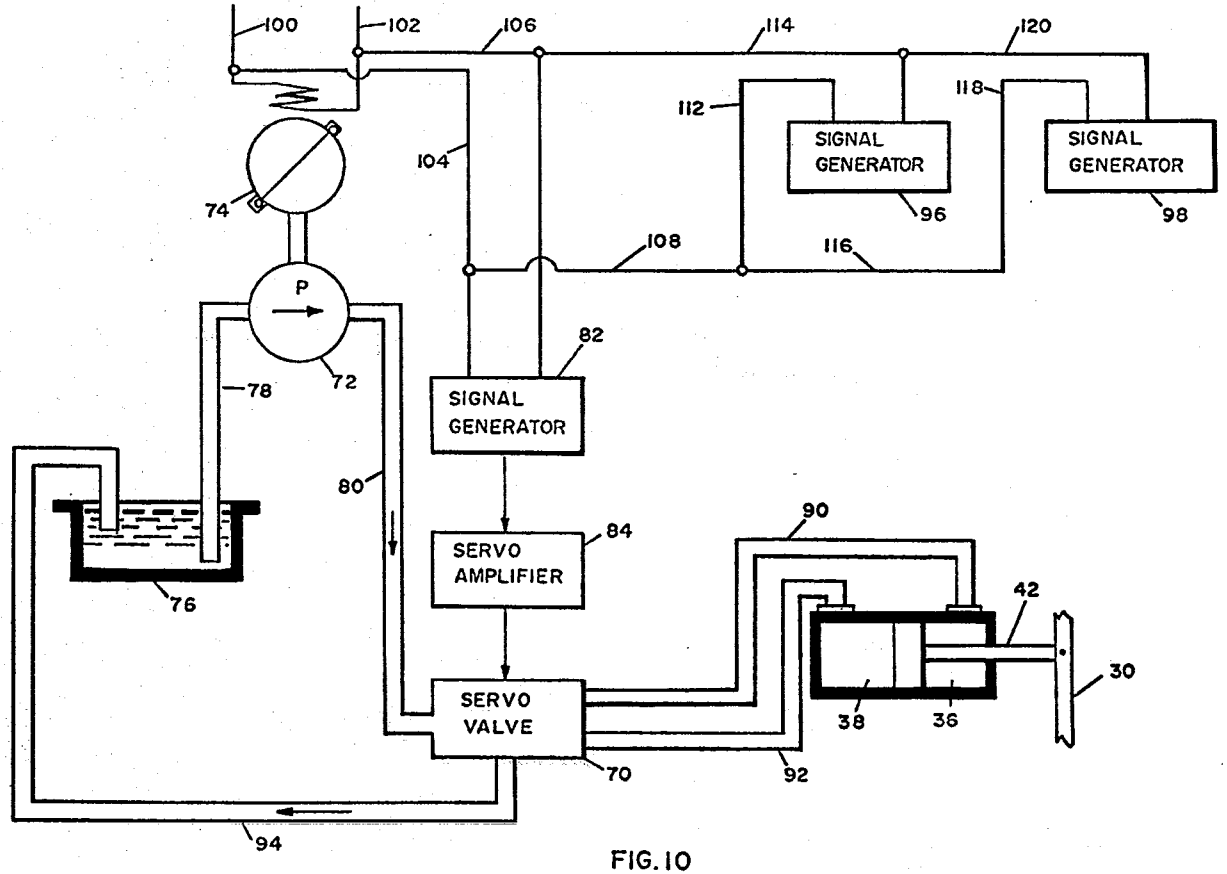
FIG. 10 is a diagrammatic view of a system for controlling one of the wave-generating members.

It is to be understood that the control of the motors 38, 56 and 60 to effect varying lengths and periods of the strokes of the wave-generating members can be accomplished in any suitable manner that is known to those skilled in the hydraulic control art. One form of control is shown diagrammatically in FIG. 10. A servovalve 70 receives liquid from a pump 72 which is driven by an electric motor 74. The liquid is withdrawn from a reservoir 76 by the pump through a pipe 78 and the liquid is forced under pressure by the pump 72 into the servovalve 70 through a pipe 80.

Various instruments, such as magnetic tapes, magnetic discs or drums, motor actuated cams, etc., can be used to control the generation of waves. A signal generator for this control purpose comprises a signal generator 82, which may be of the sweep type or controlled by a cam, to determine the stroke and frequency of the hydraulic motors. The signals generated in the signal generator 82 are amplified by a servoamplifier 84. One form of signal generator comprises a cam 86 which is rotated at a constant speed by an electric motor 88. It will be observed that the cam is provided with a plurality of teeth, whose pitch increases sequentially through a complete cycle of the cam 86. Electrical follower mechanism is controlled by the cam so that, through the servovalve, the strokes of the ram are slowed sequentially during a complete cycle of the cam.

Referring again to FIG. 10, the servovalve functions to cause hydraulic liquid to be forced into the right end of the cylinder 36 through a pipe 90 and liquid is simultaneously withdrawn from the left end of the cylinder through a pipe 92 to move the flap to generate a wave. The servovalve 70 controls the flow of the exhausted liquid to the reservoir 76 through a pipe 94. After completing the wave-creating stroke, the servovalve 70 functions to force liquid into the left end of cylinder 36 through pipe 92 and liquid flows from the right end of the cylinder through pipe 90. The exhausted liquid then flows through the servovalve 70 to the reservoir.

Each of the other two hydraulic motors 56 and 60 is controlled as described with respect to hydraulic motor 38. For simplicity, only signal generators 96 and 98 are illustrated, one being for controlling hydraulic motor 56 and the other for controlling hydraulic motor 60. Electric current is supplied to signal generator 82 through main lines 100 and 102 and by wires 104 and 106. Electric current is supplied to signal generator 96 from the main lines 100 and 102 by wires 104 and 108, wire 112, signal generator 96 and wires 114 and 106. Electric current is supplied to signal generator 98 from the mains by wires 104 and 108, wire 118, signal generator 98 and wires 120, 114 and 106.

Figure 3:
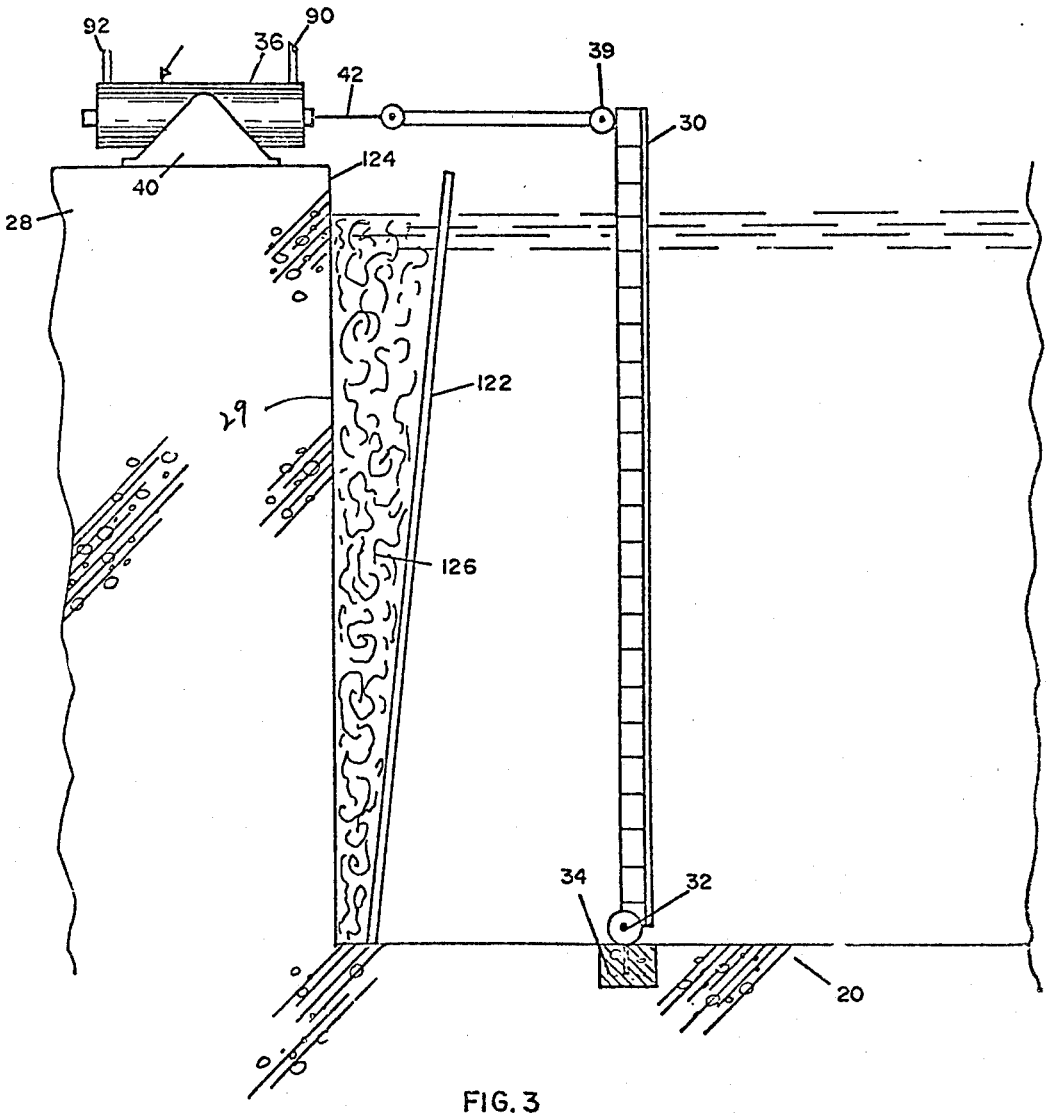
FIG. 3 is a fragmentary sectional view of the left end of the view shown in FIG. 1, but on a larger scale.
Figure 13:
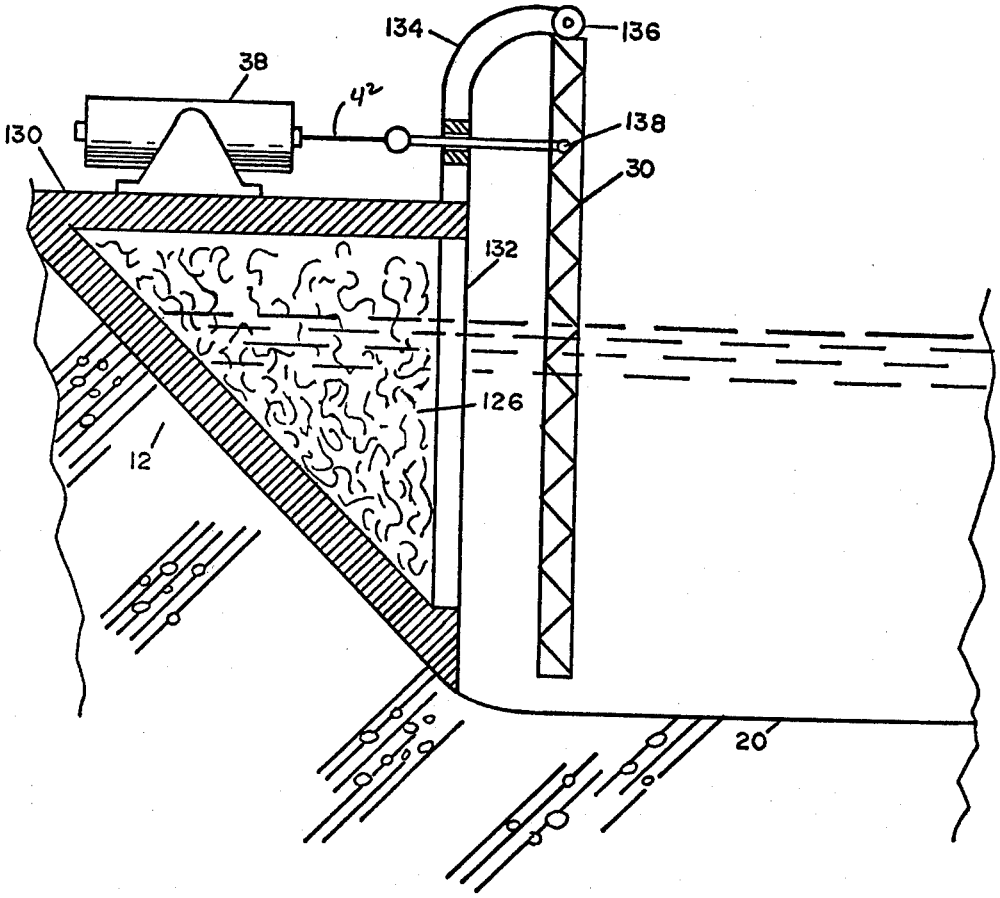
FIG. 13 shows another embodiment of the flap and the mechanism for oscillating the same.

Referring to FIG. 3, a perforated wall 122 is disposed between the vertical wall 124 of the foundation 28 and the flap 30. The area between the walls 122 and 124 contains non-buoyant material 126 such as stainless steel shavings. The purpose of the material 126 is to dissipate the wave energy behind the flaps during the reciprocation thereof. The foundation may be sloped outwardly, and broken rubble, etc., may also be used to dissipate the wave energy behind the flaps. Refer now to FIG. 13 wherein the foundation 128 angles downwardly and toward the shoal 24. A platform 130 is supported by the foundation 128 and by pillars 132. A beam 134 is carried by the platform. The upper portion of flap 30 is attached by pivot 136 to the beam. The ram 38 is attached to the flap by a pivot 138 disposed intermediate the upper and lower ends of the flap. The steel shavings 126 are disposed between the foundation and the pillars 132.

By virtue of the present invention, waves suitable for surfing have been created in a simple, inexpensive and facile manner. The flaps can be produced at low cost. These flaps are easily and readily controlled. Each wave in a train is, in itself, a relatively small wave and, therefore, a minimum amount of power is required to create the wave train.

There is a minimum of mass transport of water in the deep area where the waves are formed. The size of the waves as well as the angle between the wave front and the shoal is controlled by suitable programming of the wave generating controls.

The generating of spilling waves suitable for surfing is readily adaptable to natural bodies of water such as lakes and rivers, and is readily adaptable to man-made tanks, basins, reservoirs, etc. In the man-made system or method, the bottom of the, for example, reservoir should be suitably contoured to develop the surfing wave. Too, as heretofore set forth, the slope of the beach and the depth of water at the shoal determine the type of breakers and surfing waves that are produced.

In one example in actual practice, the depth of the water above the shoal was 6 feet. The depth of the water facing the wave generator at the foot of the shoal was approximately 20 feet. The slope of the seaward face of the shoal was approximately one in depth to three horizontal (1:3). The wave generator was approximately 500 feet from the shoal. Such space is necessary since, if the water were shallow, waves of different velocities could not be formed and waves could not be superimposed to form a surfing wave.

The distance between the shoal and the shoreline was 250 feet. A typical sequence of wave heights at the wave generator was as follows.

First wave — 3 feet
Second wave — $2\frac{1}{2}$ feet
Third wave — 2 feet
Fourth wave — $1\frac{3}{4}$ feet.

It will be understood that by making fewer waves in sequence, smaller-in-height waves at more frequent intervals will occur at the shoal, which smaller-in-height waves between the shoal and the shoreline are for mat or body surfing and for bathers. Full force of the generating machine was used successfully for skilled board surfers. This force was reduced for novices in board surfing. Thus, then, has been devised a device for board surfing, body or mat surfing and bathers who enjoy swimming in waves.

Having described my invention, I claim:

1. The method of generating waves suitable for surfing, along a shoal in a body of water, which method comprises the steps of:

generating constantly and cyclically, within an area in a body of water that is remote from the shoal, series of waves of increasing wave lengths and longer periods on a timing schedule wherein the later in time generated and faster travelling, longer period waves overtake the earlier in time generated and slower travelling, shorter wave length waves above the shoal and merge during each cycle to form a substantially single wave within a substantially confined area that lies substantially above the shoal.

2. The method as defined in claim 1, characterized to include the step of, generating constantly and cyclically, within an area lying adjacent to one side of the first mentioned area, series of waves of increasing wave lengths and longer periods on a timing schedule such that the faster travelling longer period waves overtake the shorter wave length waves at the shoal which merge to form a substantially single wave within said substantially confined area that lies substantially above the shoal.

3. The method as defined in claim 1, characterized to include the step of, generating constantly and cyclically, within an area lying adjacent to one side of the first mentioned area, series of waves of increasing wave lengths and longer periods on a timing schedule such that the faster travelling longer period waves overtake the shorter wave length waves at the shoal and which are out of phase with the first mentioned waves and which merge during each cycle to form a substantially single wave within said substantially confined area that lies substantially above the shoal.

4. The method as defined in claim 1, characterized in that the generating is effected by moving a flap toward and away from the shoal.

5. The method as defined in claim 6, characterized to include the step of, minimizing the turbulence of water that returns to the rear side of the flap, as the flap returns from its wave-creating function, by placing obstacles in the path of the flow of water that returns to the rear side of the flap.

6. The method as defined in claim 1, characterized to include the step of, creating an off-shore shoal having the characteristic of creating a surfing wave when subjected to waves of the type that cooperate with the shoal to form surfing waves.

7. The steps in the method as defined in claim 6, characterized to include, generating constantly and cyclically, within an area lying adjacent one side of the first mentioned area, series of waves of increasing wave lengths and longer periods on a timing schedule such that the faster travelling, longer period waves overtake the shorter wave length waves at the shoal during each cycle, which waves merge during each cycle to form a substantially single wave within said substantially confined area that lies substantially above the shoal.

8. The steps in the method as defined in claim 6, characterized to include, generating constantly and cyclically, within an area lying adjacent one side of the first mentioned area, series of waves of increasing wave lengths and longer periods on a timing schedule such that the faster travelling, longer period waves overtake the short wave length waves at the shoal during each cycle, which waves are out of phase with the first mentioned waves and which merge during each cycle to form a substantially single wave within said substantially confined area that lies substantially above the shoal.

9. The steps in the method as defined in claim 1, characterized in that the generating is effected by moving a flap toward and away from the shoal, and further characterized to include the step of:

minimizing the turbulence of water that returns to the rear side of the flap, as the flap returns from its wave-creating function, by placing obstacles in the path of the flow of water that returns to the rear side of the flap.

10. The method of generating waves suitable for surfing, along a shoal in a body of water, which method comprises the steps of, generating a first wave within an area in a body of water that is remote from the shoal, which wave has a first wave length, at a given time delay thereafter, generating a second wave within the body of water remote from the shoal that has a wave length with a longer period set to cause the second wave to overtake the first wave and merge therewith to form a substantially single wave within a substantially confined area that lies substantially above the shoal, and at a given time delay after generating the second wave, generating a third wave within the body of water remote from the shoal that has a wave length with a longer period set to cause the third wave to overtake the first and second waves and merge therewith to form a substantially single wave within a substantially confined area that lies substantially above the shoal.

11. A device for artificially creating waves at a shoal, which waves simulate surfing waves, said device comprising, a reciprocating wave-generating member, means for supporting the wave-generating member in the water spaced from the shoal, mechanism means for cyclically moving the wave-generating member in the water and creating waves, said mechanism means including programmed control means for controlling said mechanism means to move the wave generating member at different speeds a given number of times in the water during each cycle for sequentially creating separate waves of coordinated increasing period wave lengths during each cycle with the period of each longer wave length and the time of spacing between each wave set for the longer wave length waves to overtake the shorter wave length waves and merge all the separate waves at the shoal for each cycle, a second reciprocating wave-generating member, means for supporting the second wave-generating member in the water spaced from the shoal, second mechanism means for cyclically moving the second wave-generating member in the water and creating waves, and said second mechanism means including second programmed control means for controlling said second mechanism means to move the second wave generating member a given number of times in the water during each cycle for sequentially creating separate waves of increasing period wave lengths during each cycle with the period of each longer wave length and the time of spacing between each wave set for the longer wave length waves to overtake the shorter wave length waves and merge all the separate waves at the shoal for each cycle.

12. A device as defined in claim 11, characterized to include:

means for causing said first and second control means to move said first and second wave-generating members in out-of-phase relationship with one another.

* * * * *